US009139016B2

(12) United States Patent
Kagata

(10) Patent No.: US 9,139,016 B2
(45) Date of Patent: Sep. 22, 2015

(54) PRINTING APPARATUS, PRINTING METHOD, AND PRINTING PROGRAM

(71) Applicant: SEIKO EPSON CORPORATION, Tokyo (JP)

(72) Inventor: Takayoshi Kagata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/659,487

(22) Filed: Oct. 24, 2012

(65) Prior Publication Data

US 2013/0106937 A1 May 2, 2013

(30) Foreign Application Priority Data

Oct. 27, 2011 (JP) ..... 2011-235731

(51) Int. Cl.
*B41J 2/205* (2006.01)
*B41J 2/21* (2006.01)

(52) U.S. Cl.
CPC ..... *B41J 2/2107* (2013.01)

(58) Field of Classification Search
CPC ..... B41J 2/2107
USPC ..... 347/9, 14, 15
See application file for complete search history.

(56) References Cited

U.S. PATENT DOCUMENTS

2007/0076069 A1* 4/2007 Edwards et al. ..... 347/100
2009/0244118 A1* 10/2009 Kakutani ..... 347/6

FOREIGN PATENT DOCUMENTS

JP 11-078204 3/1999
JP 11078204 A * 3/1999
JP 2009-220423 10/2009

OTHER PUBLICATIONS

Shimizu, "Machine-Translation-of—JP,11-078204,A(1999).pdf", 1999.*
Shimizu, MachineTranslationof—JP11-078204A, 1999.*

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A printing apparatus includes an image disposition processing unit that disposes a metallic image and a color image as a printing image. The image disposition processing unit disposes a color image in an outline area of the printing image.

3 Claims, 13 Drawing Sheets

IMAGE DISPOSITION PATTERN (STRIPE SHAPE)

IMAGE DISPOSITION PATTERN (GRID SHAPE)

IMAGE DISPOSITION PATTERN (CHECKER BOARD SHAPE)

PRINTING APPARATUS, PRINTING METHOD, AND PRINTING PROGRAM

CROSS-REFERENCE TO RELATED APPLICATIONS

The entire disclosure of Japanese Patent Application No. 2011-235731, filed Oct. 27, 2011 is expressly incorporated by reference herein.

BACKGROUND

1. Technical Field

The present invention relates to a printing apparatus, a printing method, and a printing program.

2. Related Art

A printing apparatus that ejects a liquid to land ink droplets (dots) onto a medium to thereby perform recording is known. In such a printing apparatus, in addition to a general color ink (for example, color ink of KCMY), metal ink including metal particles such as fine aluminum particles may be used as a pigment to perform printing.

In the metallic printing using the metal ink, a balance between metal luster and color tone of a printed object is changed according to the amount of metal particles contained in the metal ink. For this reason, it is difficult to realize metallic printing having a satisfactory metal luster with a desired color tone. Meanwhile, when printing is performed using ink containing fine aluminum particles as metal particles, a printing method is proposed in which a printing shape of the ink on a medium is substantially reticulate, and the amount of fine aluminum particles included in a printed object is adjusted by changing the size of reticulation to adjust metal luster. (for example JP-A-11-78204).

However, in a case of the printing method disclosed in JP-A-11-78204, it is possible to print an image having a satisfactory metal luster with a high image quality, but the impression that the entire image of the metallic printing floats on the medium may be given. For this reason, according to a user, an undesirable image may be obtained due to a reason that the image is unnatural or excessively stands out.

SUMMARY

The invention can be realized in the following forms or application examples.

Application Example 1

According to Application Example 1, there is provided a printing apparatus which forms a printing image in which a metallic image formed of metal ink and a color image formed of color ink are alternately disposed on a medium, including: an image disposition processing unit that disposes the metallic image and the color image as the printing image, wherein the image disposition processing unit disposes the color image in an outline area of the printing image.

According to the printing apparatus, when the printing is performed using the metal ink and the color ink, the metallic image and the color image are alternately disposed on the medium, and thus it is possible to realize the metallic printing having a satisfactory metal luster and color tone. In addition, the color image is disposed in the outline area of the printing image formed of the metallic image and the color image, and thus it is possible to make the boundary portion of the printing image a blurred impression. Accordingly, it is possible to suppress the entire image of the metallic printing floating on the medium, and thus it is possible to provide a preferable image.

Application Example 2

In the printing apparatus according to Application Example 1, the line width of the color image disposed in the outline area may be larger than the line width of the color image disposed in an area surrounded in the outline area.

According to the printing apparatus, it is possible to broaden the line width of the color image forming the boundary portion of the printing image on the medium, and thus it is possible to make the boundary portion the blurred impression in the broader range. Accordingly, it is possible to further suppress that the entire image of the metallic printing floats on the medium.

Application Example 3

In the printing apparatus according to Application Example 1, the outline area may be an area adjacent to the outside of an outline of the printing image.

According to the printing apparatus, it is possible to provide the outline area that is the boundary portion of the printing image, on the outside of the outline. Accordingly, it is possible to hold and print the content of the printing image as is before providing the outline area.

Application Example 4

In the printing apparatus according to Application Example 1, the outline area may be an area adjacent to the inside of an outline of the printing image.

According to the printing apparatus, it is possible to provide the outline area that is the boundary portion of the printing image, on the inside of the outline. Accordingly, it is possible to hold, as it is, and print the size of the printing image before providing the outline area.

Application Example 5

According to Application Example 5, there is provided a printing control device which forms a printing image in which a metallic image formed of metal ink and a color image formed of color ink are alternately disposed on a medium, including: an image disposition processing unit that disposes the metallic image and the color image as the printing image, wherein the image disposition processing unit disposes the color image in an outline area of the printing image.

According to the printing control device, when the printing is performed using the metal ink and the color ink, the metallic image and the color image are alternately disposed on the medium, and thus it is possible to realize the metallic printing having a satisfactory metal luster and color tone. In addition, the color image is disposed in the outline area of the printing image formed of the metallic image and the color image, and thus it is possible to make the boundary portion of the printing image a blurred impression. Accordingly, it is possible to suppress that the entire image of the metallic printing floats on the medium, and thus it is possible to provide a preferable image.

Application Example 6

According to Application Example 6, there is provided a printing object on which a printing image is formed in which a metallic image formed of metal ink and a color image formed of color ink are alternately disposed on a medium, wherein the color image is disposed in an outline area of the printing image.

According to the printed object, the metallic image and the color image are alternately disposed on the medium, and it is possible to realize the image of the metallic printing having satisfactory a metal luster and color tone. In addition, the color image is disposed in the outline area of the printing image formed of the metallic image and the color image, and thus it is possible to make the boundary portion of the printing image a blurred impression. Accordingly, it is possible to suppress that the entire image of the metallic printing floats on the medium, and thus it is possible to provide a preferable image.

Application Example 7

According to Application Example 7, there is provided a printing method of forming a printing image in which a metallic image formed of metal ink and a color image formed of color ink are alternately disposed on a medium, the printing method including: disposing the metallic image and the color image as the printing image, wherein in the disposing of the metallic image and the color image, the color image is disposed in an outline area of the printing image.

According to the printing method, when the printing is performed using the metal ink and the color ink, the metallic image and the color image are alternately disposed on the medium, and thus it is possible to realize the metallic printing having a satisfactory metal luster and color tone. In addition, the color image is disposed in the outline area of the printing image formed of the metallic image and the color image, and thus it is possible to make the boundary portion of the printing image a blurred impression. Accordingly, it is possible to suppress that the entire image of the metallic printing floats on the medium, and thus it is possible to provide a preferable image.

Application Example 8

According to Application Example 8, there is provided a printing program of forming a printing image in which a metallic image formed of metal ink and a color image formed of color ink are alternately disposed on a medium, the printing program for causing a computer to execute the function of: disposing the metallic image and the color image as the printing image, wherein in the disposing of the metallic image and the color image, the color image is disposed in an outline area of the printing image.

According to the printing program, when the printing is performed using the metal ink and the color ink, the metallic image and the color image are alternately disposed on the medium, and thus it is possible to realize the metallic printing having a satisfactory metal luster and color tone. In addition, the color image is disposed in the outline area of the printing image formed of the metallic image and the color image, and thus it is possible to make the boundary portion of the printing image a blurred impression. Accordingly, it is possible to suppress that the entire image of the metallic printing floats on the medium, and thus it is possible to provide a preferable image.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a printing apparatus according to an embodiment will be described with reference to the drawings.

Configuration of Printing System

A configuration of the printing apparatus according to the embodiment will be described.

Figure 1:
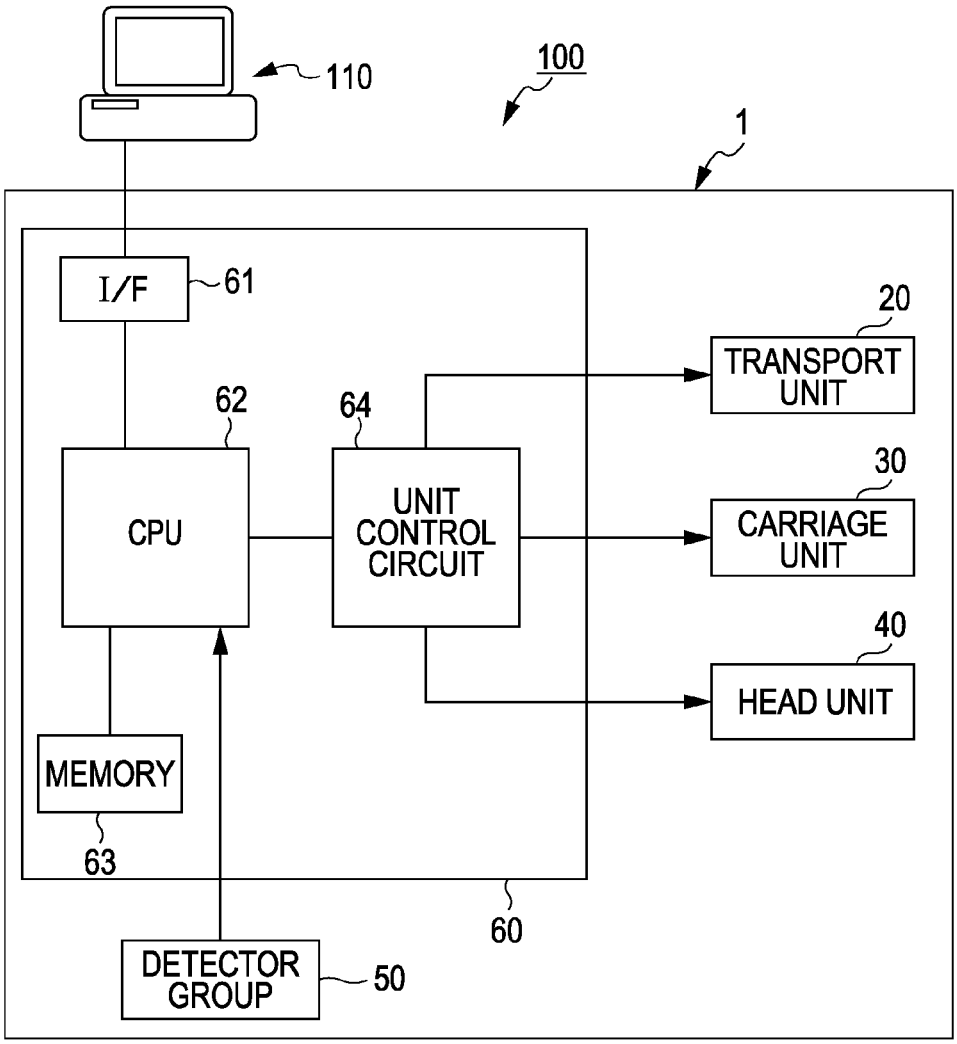
FIG. 1 is a block diagram illustrating an overall configuration of a printing system.

FIG. 1 is a block diagram illustrating an overall configuration of a printing system 100.

As shown in FIG. 1, the printing system 100 includes a computer 110, an ink jet printer 1 (hereinafter, referred to as "printer 1") that actually prints an image under a control of the computer 110, and the like.

The printer 1 is a printing apparatus that forms (prints) a text or an image on a medium such as paper, cloth, film, or the like, and is communicably connected to the computer 110. In addition, a printer driver as a printing control device is installed in the computer 110. In addition, the printing system 100 integrally serves as a printing apparatus in the broad sense of the term.

Printer Driver

Next, the printer driver in the computer 110 will be described.

Figure 2:
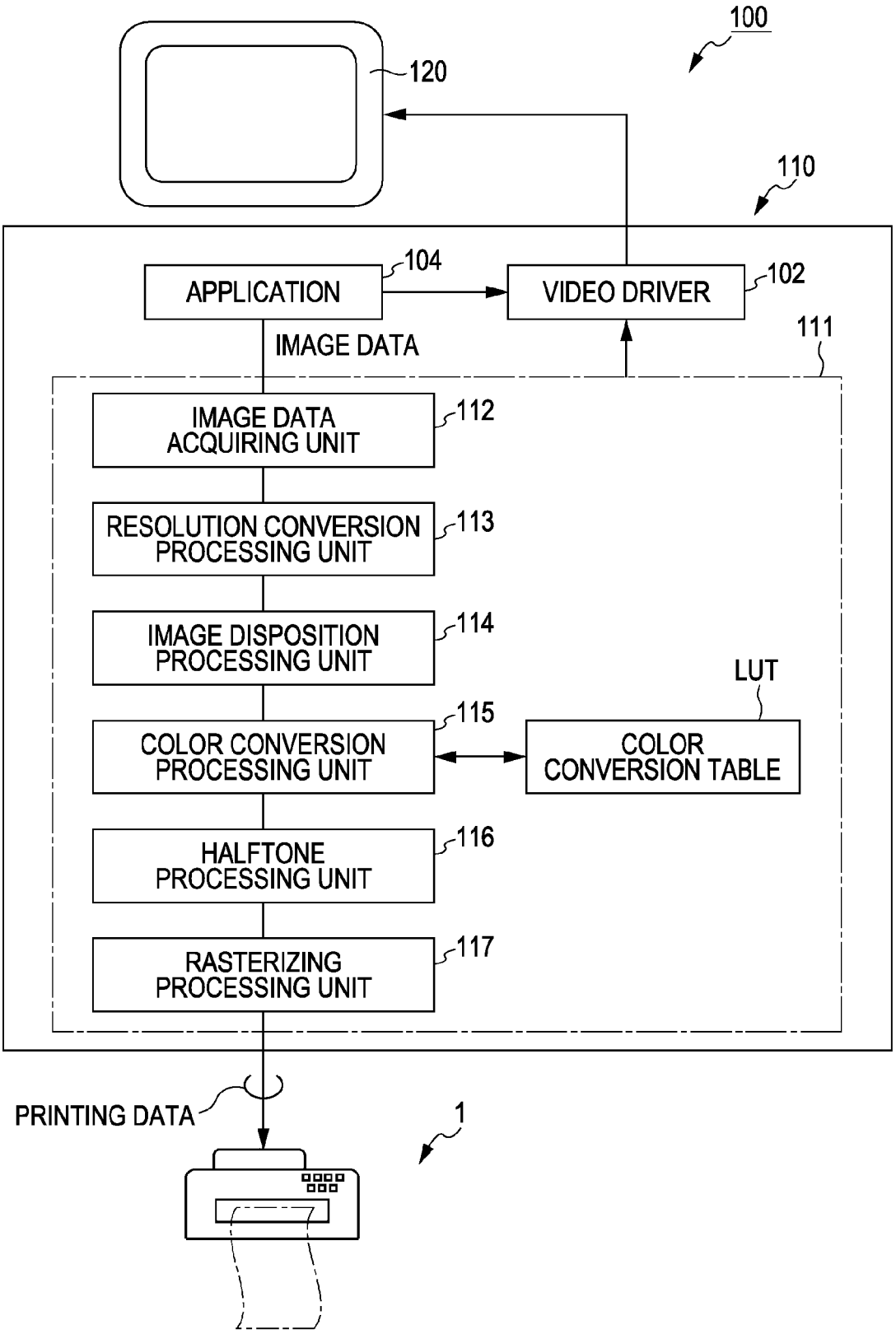
FIG. 2 is a schematic diagram illustrating a basic process performed by a printer driver.

FIG. 2 is a schematic diagram illustrating a basic process performed by the printer driver 111.

In the computer 110, computer programs such as a video driver 102, an application program 104, and the printer driver 111 are operated under an operating system installed on the computer 110. The video driver 102 has a function of displaying, for example, a user interface or the like on a display device 120, according to a display command from the application program 104 or the printer driver 111. The user may perform various settings in the printer driver 111 using an input device (not shown) through the displayed user interface.

The application program 104 has a function of, for example, editing an image, and generates data about an image (image data). The user may instruct to print the image edited by the application program 104 through the user interface of the application program 104. When a printing instruction is received, the application program 104 outputs image data to the printer driver 111.

The printer driver 111 receives the image data from the application program 104, converts the image data into printing data, and outputs the converted printing data to the printer 1. To converts the image data output from the application program 104 into the printing data, the printer driver 111 is provided with an image data acquiring unit 112, a resolution conversion processing unit 113, an image disposition processing unit 114, a color conversion processing unit 115, a halftone processing unit 116, and a rasterizing processing unit 117. Processes in the image data acquiring unit 112, the resolution conversion processing unit 113, the image disposition processing unit 114, the color conversion processing unit 115, the halftone processing unit 116, and the rasterizing processing unit 117 will be described in detail in description of "Operation in Printer Driver" to be described later.

In addition, the process of the printer driver 111 may not be performed on the computer 110 side but may be performed on the printer 1 side.

Printer

Next, the printer 1 will be described.

Returning to FIG. 1, the printer 1 includes a transport unit 20, a carriage unit 30, a head unit 40, a detector group 50, and a controller 60. The controller 60 controls the units on the basis of the printing data received from the computer 110 to print an image on the medium. In addition, a situation in the printer 1 is monitored by the detector group 50, and the detector group 50 outputs the detection result to the controller 60. The controller 60 controls the units on the basis of the detection result output from the detector group 50.

Figure 3A:
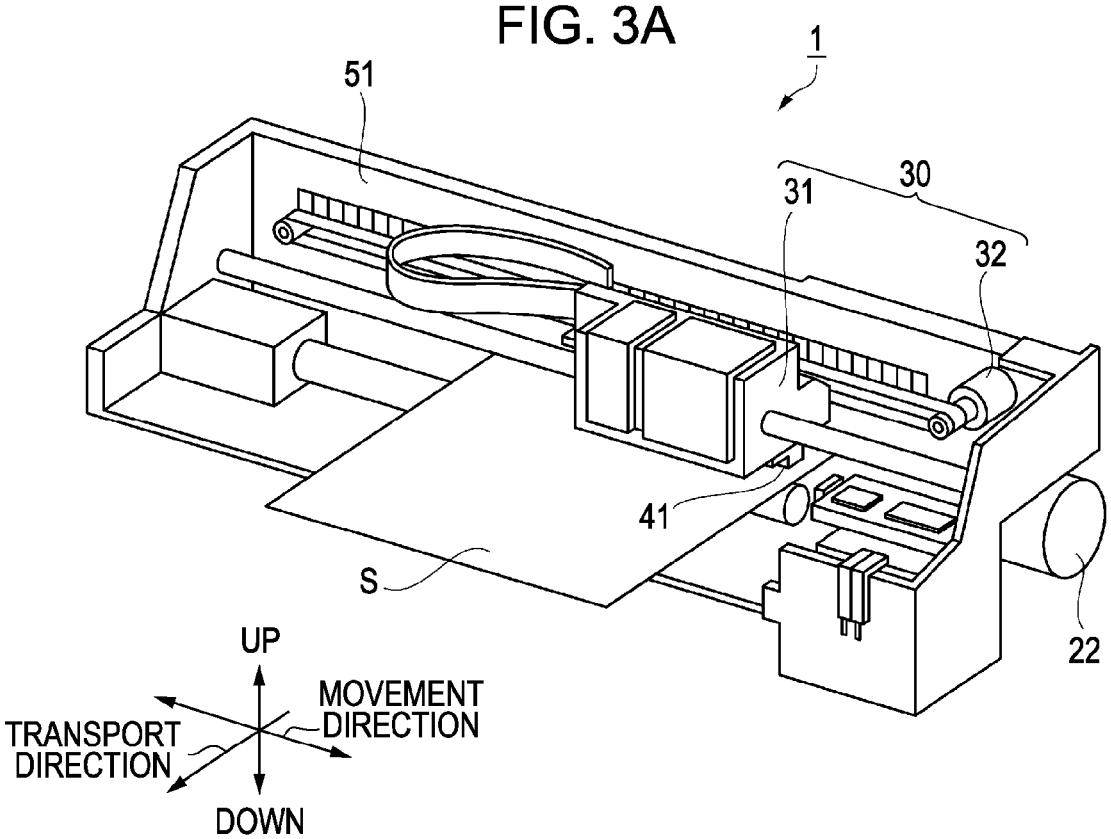
FIG. 3A and FIG. 3B are diagrams illustrating a configuration of a printer.
Figure 3B:
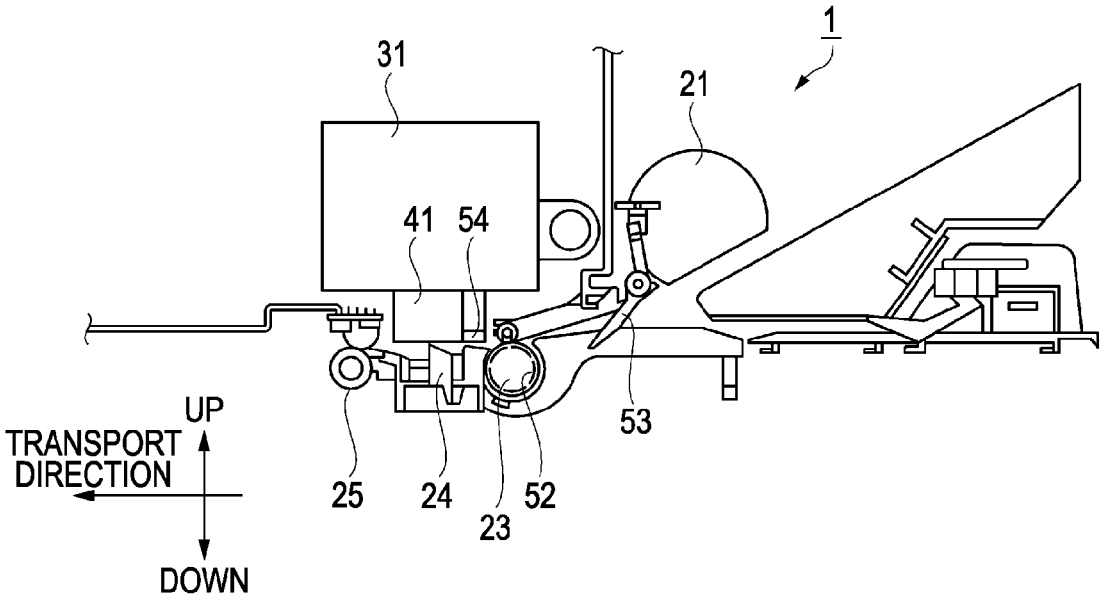

FIG. 3A is a perspective view illustrating a configuration of the printer 1. FIG. 3B is a side view illustrating a configuration of the printer 1.

The transport unit 20 (see FIG. 1) transports the medium S in a predetermined direction (hereinafter, referred to as "transport direction"). Herein, the transport direction is a direction intersecting a movement direction of a carriage 31. The transport unit 20 includes a sheet feeding roller 21, a transport motor 22, a transport roller 23, a platen 24, and a sheet discharge roller 25.

The sheet feeding roller 21 is a roller for feeding the medium S inserted into a sheet insertion port, into the printer 1. The transport roller 23 is a roller that transports the medium S fed by the sheet feeding roller 21, to a printable area, and is driven by the transport motor 22. An operation of the transport motor 22 is controlled by the controller 60 (see FIG. 1). The platen 24 is a member that supports the medium S on which printing is being performed, from the back side of the medium S. The sheet discharge roller 25 is a roller that discharges the medium S to the outside of the printer 1, and is provided on the transport direction downstream side in the printable area.

The carriage unit 30 (see FIG. 1) moves (scans) the carriage 31 provided with the head unit 40 (see FIG. 1) in a predetermined direction (hereinafter, referred to as "scanning direction"). The carriage unit 30 includes the carriage 31 and a carriage motor 32.

The carriage 31 is reciprocally moved in the scanning direction, and is driven by the carriage motor 32. The operation of the carriage motor 32 is controlled by the controller 60. In addition, the carriage 31 detachably holds the cartridge that accommodates ink for printing an image.

The head unit 40 ejects the ink onto the medium S. The head unit 40 includes a head 41 having a plurality of nozzles. The head 41 is provided in the carriage 31. When the carriage 31 is moved in the scanning direction, the head 41 is also moved in the scanning direction. The head 41 discontinuously ejects ink droplets during the movement in the scanning direction, to form a dot line (a raster line) along the scanning direction on a sheet.

Figure 4:
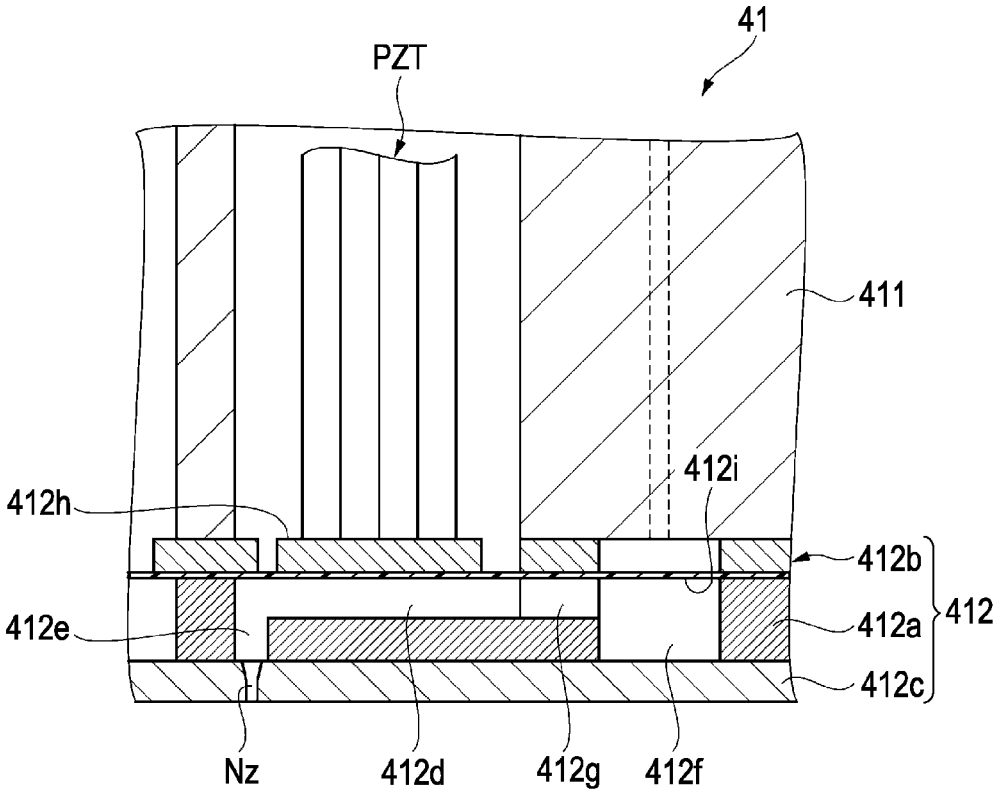
FIG. 4 is a cross-sectional view illustrating a structure of a head.

FIG. 4 is a cross-sectional view illustrating a structure of the head 41.

As shown FIG. 4, the head 41 includes a case 411, a flow path unit 412, a piezoelectric element group PZT. The case 411 houses the piezoelectric element group PZT, and the flow path unit 412 is bonded to the lower face of the case 411. The flow path unit 412 includes a flow path formation plate 412*a*, an elastic plate 412*b*, and a nozzle plate 412*c*. The flow path formation plate 412*a* is provided with a groove portion that is a pressure chamber 412*d*, a through-hole that is a nozzle communication port 412*e*, a through-hole that is a common ink chamber 412*f*, and a groove portion that is an ink supply path 412*g*. The elastic plate 412*b* has an island portion 412*h* to which the front end of the piezoelectric element group PZT is bonded. An elastic area formed by an elastic film 412*i* is around the island portion 412*h*. The ink stored in the ink cartridge is supplied to the pressure chamber 412*d* corresponding to each nozzle Nz through the common ink chamber 412*f*. The nozzle plate 412*c* is a plate provided with the nozzles Nz.

The piezoelectric element group PZT has a plurality of pectinate piezoelectric elements (driving elements), which are provided corresponding to the nozzles Nz. When a driving signal is applied to a piezoelectric element by a wiring substrate (not shown) provided with a head control unit (not shown) and the like, the piezoelectric element extends and contracts in an up and down direction according to potential of the driving signal. When the piezoelectric element extends and contracts, the island portion 412*h* is pushed to the pressure chamber 412*d* or is drawn in the opposite direction. In this case, the elastic film 412*i* around the island portion 412*h* is deformed, the pressure in the pressure chamber 412*d* is increased or decreased, and thus the ink droplets are ejected from the nozzles Nz.

Figure 5:
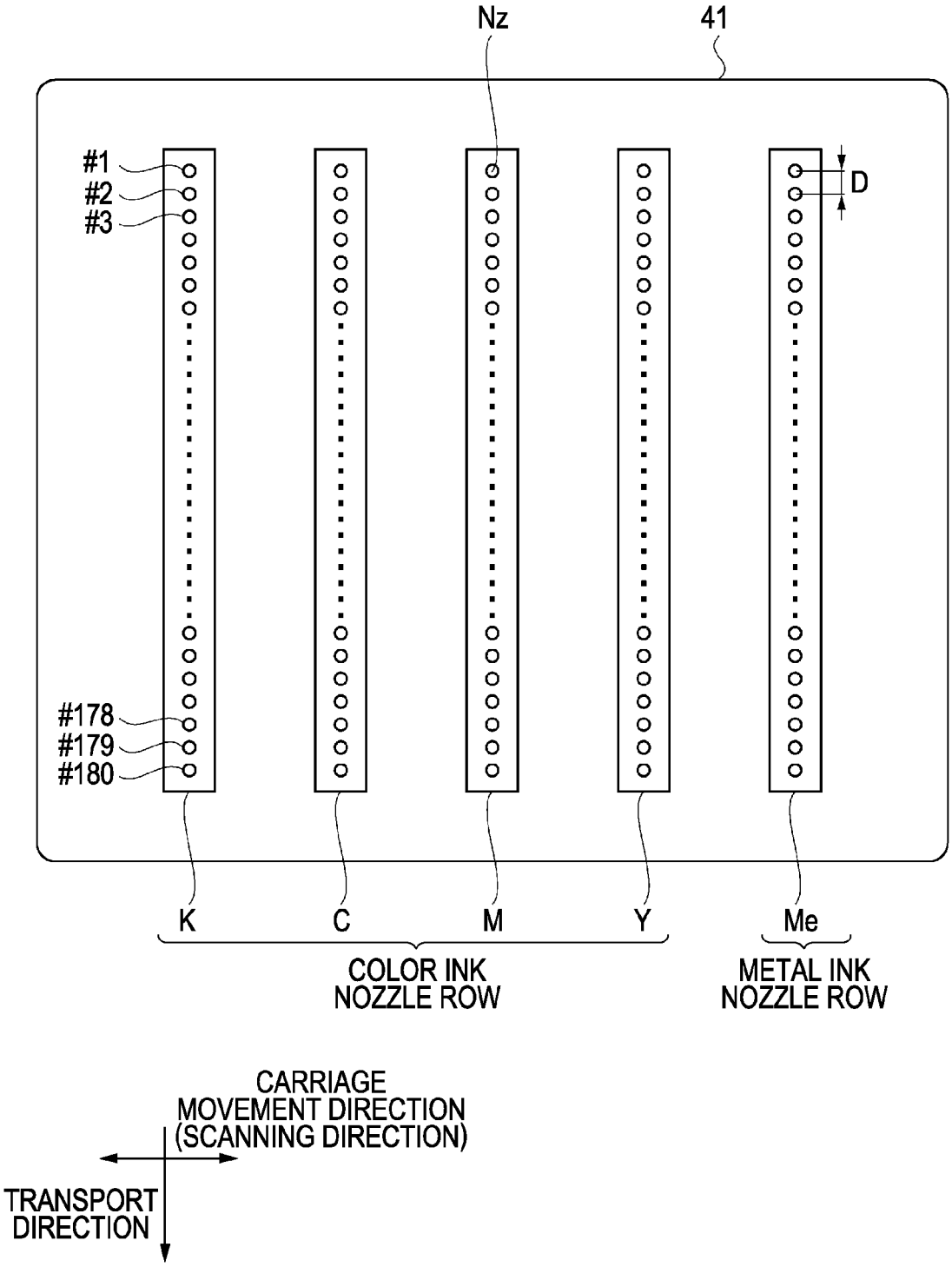
FIG. 5 is a diagram illustrating nozzles provided on a bottom face of the head.

FIG. 5 is a diagram illustrating the nozzles Nz provided on the bottom face of the head 41.

As shown in FIG. 5, color ink nozzle rows formed of a black nozzle row K for ejecting black ink, a cyan nozzle row C for ejecting cyan ink, a magenta nozzle row M for ejecting magenta ink, a yellow nozzle row Y for ejecting yellow ink, and a metal ink nozzle row Me for ejecting metal ink are formed on the bottom face of the head 41. In addition, in each nozzle row of KCMY and Me, the nozzles Nz that are ejection holes for ejecting each color of ink are arranged at a predetermined distance D in the transport direction. Each nozzle row is provided with 180 nozzles of #1 to #180.

In addition, the actual number of nozzles in each nozzle row is not limited 180, and the number of nozzles may be, for example, 90 or 360. In addition, in FIG. 5, the nozzle rows are arranged in parallel in the scanning direction, but may be arranged longitudinally along the transport direction. In addition, for each color of KCMY and Me, each row may not be provided, but a plurality of nozzle rows may be provided for each color.

The detector group 50 (see FIG. 1) monitors a situation of the printer 1. The detector group 50 includes linear encoder 51, a rotary encoder 52, a sheet detection sensor 53, an optical sensor 54, and the like (see FIG. 3A and FIG. 3B).

The linear encoder 51 detects the position of the carriage 31 in the scanning direction. The rotary encoder 52 detects the amount of rotation of the transport roller 23. The sheet detection sensor 53 detects a position of the leading end of the medium S which is being fed. The optical sensor 54 detects whether or not the medium S is present at a position opposed to the light emitting unit and the light receiving unit provided in the carriage 31, for example, detects the position of the end portion of the medium S while moving, and thus it is possible to detect the width of the medium S. In addition, the optical sensor 54 may also detect the leading end (the end portion on the transport direction downstream side) and the trailing end (the end portion on the upstream side in the transport direction) of the medium S, according to a situation.

The controller 60 (see FIG. 1) is a control unit that controls the printer 1. The controller 60 includes an interface unit 61, a CPU 62, a memory 63, and a unit control circuit 64.

The interface unit 61 performs transmission and reception of data between the computer 110 that is an external apparatus and the printer 1. The CPU 62 is an operation processing device that controls the whole of the printer 1. The memory 63 secures a program storing area or a work area of the CPU 62, and is formed of a storage element such as a RAM and an EEPROM. The CPU 62 controls the units such as the transport unit 20, the carriage unit 30, and the head unit 40 through the unit control circuit 64 according to the program stored in the memory 63.

Printing Operation

Next, a printing operation of the printer 1 will be schematically described.

The controller 60 receives a printing command through the interface unit 61 from the computer 110, and controls the units, to perform a sheet feeding process, a dot forming process, a transport process, and the like.

The sheet feeding process is a process of supplying the medium S to be printed into the printer 1 and determining the position of the medium S at a printing start position (a cue position). The controller 60 rotates the sheet feeding roller 21 to transport the medium S to be printed to the transport roller 23. Subsequently, the controller 60 rotates the transport roller 23 to determine the position of the medium S transported from the sheet feeding roller 21 at the printing start position.

The dot forming process is a process of discontinuously ejecting ink droplets from the head 41 moving along the scanning direction to form dots on the medium S. The controller 60 moves the carriage 31 in the scanning direction to eject ink droplets from the head 41 on the basis of the printing data while the carriage 31 is moved. When the ejected ink droplets land on the medium S, the dots are formed on the medium S, and a dot line formed of a plurality of dots along the scanning direction is formed on the medium S.

The transport process is a process of relatively moving the medium S along the transport direction with respect to the head 41. The controller 60 rotates the transport roller 23 to transport the medium S in the transport direction. By this transport process, the head 41 may form the dots at a position different from the position of the dots formed by the previous dot forming process.

The controller 60 alternately repeats the dot forming process and the transport process until the data to be printed is not present, and gradually prints an image configured by the dot lines on the medium S. When the data to be printed is not present, the controller 60 rotates the sheet discharge roller 25 to discharge the medium S. In addition, the determination whether or not to perform the discharge of the sheet may be performed on the basis of a discharge command included in the printing data.

In the printing operation of the printer 1, there is "one-way printing" in which the ink droplets are ejected from the nozzles Nz on the forward path on which the head 41 moves from the right side (home position) to the left side in the scanning direction and the ink droplets are not ejected from the nozzles Nz on the backward path on which the head 41 moves from the left side to the right side in the scanning direction, and there is "bidirectional printing" in which the ink droplets are ejected from the nozzle Nz on the forward path and the backward path. The printing method described in the embodiment may correspond to any printing operation of the "one-way printing" and the "bidirectional printing".

Metal Ink

Next, the metal ink used in the printing will be described.

The metal ink contains silver particles, aluminum particles, or the like as metal particles. From the metal ink containing the aluminum particles, it is possible to obtain bright metal luster on the printing face. However, aluminum particles are easily oxidized, and the printing face may turn white with the passage of time. Meanwhile, in the metal ink containing the silver particles, there is a problem that the color of the metal luster easily becomes dark compared with the ink containing the aluminum particles and a cost thereof is high, but the metal ink containing the silver particles has a property of excellent stability in that they are not easily oxidized.

The metal ink used at the time of printing may be selected according to the usage of printing, but in the embodiment, printing using the metal ink containing the silver particles will be described. In addition, according to the printing method of the embodiment, it is possible to solve the problem of high cost or dark color when using the silver particles described above.

The solvent of the metal ink may be pure water or ultrapure water such as ion-exchange water ultrafiltration water, reverse osmosis water, and distilled water. Ions may be present in water as long as they do not interfere with dispersion of metal particles. In addition, as necessary, it may contain surfactants, polyhydric alcohol, pH adjustment agents, resins, colorants, and the like.

The silver particles included in the ink composition of the embodiment are particles including silver as a main component. The silver particles may include, for example, other metals, oxygen, carbon, and the like, as a sub-component. The purity of silver in the silver particles may be, for example, equal to or more than 80%. The silver particles may be alloy between silver and the other metal. In addition, the silver particles in the ink composition may be present in a colloid (particle colloid) state. When the silver particles are dispersed in the colloid state, the dispersion property is more satisfactory, for example, it is possible to contribute to improvement of reservation stability of the ink composition.

A particle diameter d90 in a grain size accumulation curve of the silver particles is equal to or more than 50 nm and equal to or less than 1 μm. Herein, the grain size accumulation curve is a kind of curve obtainable by statistically processing a result of measurement of acquiring diameters of particles and the number of present particles for the silver particles dispersed in the liquid such as the ink composition. In the grain size accumulation curve in the embodiment, a diameter of particles is in the horizontal axis, and a value (an integration value) of integration from particles with a small diameter to particles with a larger diameter with respect to a mass (a product of volume, density of particles, and the number of particles when it is assumed that the particles are spheres) of particles is in the vertical axis. The diameter d90 means a value of the horizontal axis, that is, a diameter of particles, when the vertical axis is normalized (the total mass of the measured particles is 1) and the value of the vertical axis is 90% (0.90) in the grain size accumulation curve. In addition, the diameter of the silver particles in this case may be a diameter of the silver particles, and may be a diameter of particle colloid when the silver particles are dispersed in a colloid form.

The grain size accumulation curve of the silver particles may be acquired, for example, using a particle diameter distribution measuring device based on a dynamic light scattering method. The dynamic light scattering method is a method of irradiating dispersed silver particles with laser light and observing diffusion light thereof using a photon detector. Generally, the dispersed silver particles perform normal Brownian motion. The speed of motion of the silver particles gets higher as the particle diameter gets larger, and the speed gets lower as the particle diameter gets smaller. When the silver particles which are performing Brownian motion are irradiated with laser light, fluctuation corresponding to the Brownian motion of each particle is observed for diffusion light. By measuring this fluctuation, an autocorrelation function is acquired by a photon correlation method, and a diameter of silver particles or frequency (the number) of silver particles corresponding to the diameter may be acquired using a cumulant method and a histogram analysis method, or the like. Particularly, for a sample including silver particles with a sub-micron size, the dynamic light scattering method is suitable, and it is possible to relatively easily obtain the grain size accumulation curve according to the dynamic light scattering method.

A particle diameter distribution measuring device based on the dynamic light scattering method may be, for example, Nanotrac UPA-EX150 (manufactured by Nikkiso Co., Ltd.), ELSZ-2, DLS-8000 (manufactured by Otsuka Electronics Co., Ltd.), LB-550 (manufactured by Horiba, Ltd.), or the like.

Operation in Printer Driver

Next, an operation in the printer driver 111 will be described.

Figure 6:
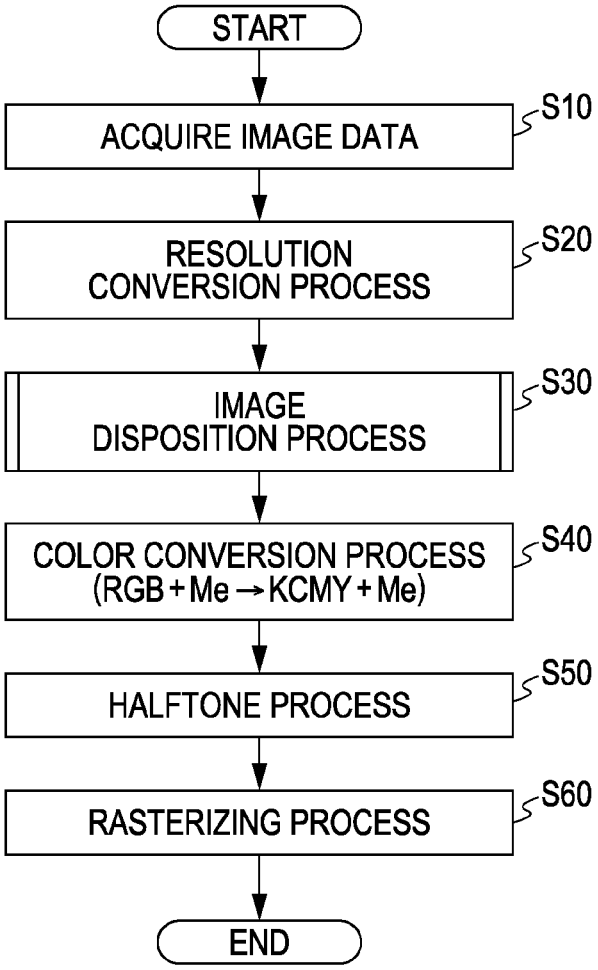
FIG. 6 is a flowchart illustrating an operation in the printer driver.

FIG. 6 is a flowchart illustrating an operation in the printer driver 111.

Each operation in Step S10 to S60 shown in FIG. 6 is performed on the basis of an instruction from the printer driver 111 installed in the computer 110. Hereinafter, the operation in the printer driver 111 will be described in detail.

When the user instructs the application program 104 to start printing, the printer driver 111 is called. The printer driver 111 acquires image data (original image data) that is a printing target from the application program 104 by the image data acquiring unit 112 (Step S10). The printer driver 111 performs a resolution conversion process (Step S20) on the acquired image data by the resolution conversion processing unit 113.

Herein, the resolution conversion process is a process of converting the image data (text data, image data, and the like) into resolution (printing resolution) when printing on the medium S. For example, when the printing resolution is designated to 720×720 dpi, the image data of a vector format received from the application program 104 is converted into image data of a bitmap format with the resolution of 720×720 dpi. The pixel data of the image data after the resolution conversion process is configured from data of gradations (for example, 256 gradations) represented by an RGB color space and data of gradation (for example, 256 gradations) represented by a metallic (Me) color space.

Next, the printer driver 111 performs an image disposition process of thinning out a part of the images in an overlapped area and alternately disposing them on the medium S, on the metallic image and the color image overlapped on the medium S, by the image disposition processing unit 114 (Step S30). The image disposition process will be described later in detail.

In addition, herein, it is assumed that an image including the metallic image is printed. However, it is preferable to perform printing according to the method of the related art without performing the image disposition process on the general color printing which not include the metallic image.

Next, the printer driver 111 performs a color conversion process of converting the image data according to the color space of the ink color of the printer 1 by the color conversion processing unit 115 (Step S40). Herein, the image data of "RGB color space+Me" is converted into image data of "KCMY color space+Me). The color conversion process is performed on the basis of a color conversion table LUT (see FIG. 2) in which the gradation values of RGB data and the gradation values of the KCMY data are associated with each other. Through this color conversion process, it is possible to obtain the image data of the KCMY color space. The pixel data after the color conversion process is 8-bit data of 256 gradations represented by "KCMY color space+Me". In addition, it is difficult to express the metal ink color (Me) in the combination of KCMY, and thus it is considered a special color, and the color conversion process is not performed.

After the color conversion process, the printer driver 111 performs a halftone process of converting data with the number of high gradations into data with the number of low gradations which can be formed by the printer 1, by the halftone processing unit 116 (Step S50). Herein, the image data with 256 gradations is converted into 1-bit data representing 2 gradations or 2-bit data representing 4 gradations. In addition, as the halftone processing method, for example, a halftone process based on a dithering method or an error diffusion method is performed. The halftone-processed data has resolution equivalent to recording resolution (for example, 720×720 dpi). In the image data after the halftone process, 1-bit or 2-bit pixel data is associated, and the pixel data is data representing a dot formation situation (presence or absence of dots and sizes of dots) in each pixel.

Next, the printer driver 111 performs a rasterizing process of changing a line sequence of the pixel data on the printing image data to a data sequence to be transmitted to the printer 1 by the rasterizing processing unit 117 (Step S60). Herein, the pixel data is sorted according to the line sequence of the nozzles Nz of the nozzle rows K, C, M, Y, and Me. Thereafter, the printer driver 111 adds control data for controlling the printer 1 to the pixel data to generate printing data, and transmits the printing data to the printer 1.

The printer 1 performs a printing operation according to the received printing data. Specifically, the controller 60 of the printer 1 controls the transport unit 20, the carriage unit 30, and the like according to the control data of the received printing data, and controls the head unit 40 according to the pixel data of the printing data, to eject the color ink and the metal ink from the nozzles Nz provided in the head 41.

Details of Image Disposition Process

Next, the image disposition process in Step S30 shown in FIG. 6 will be described in detail.

Figure 7:
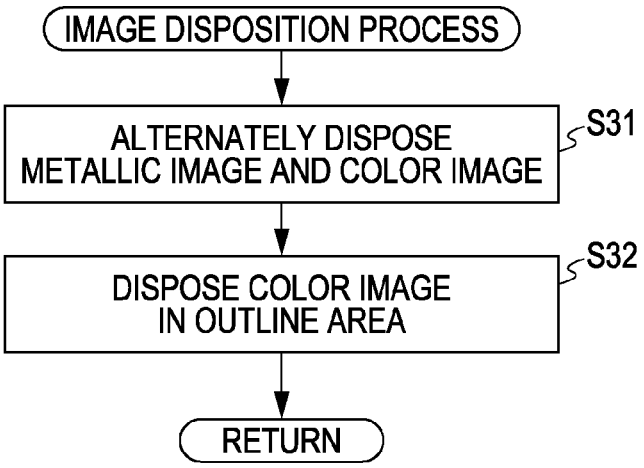
FIG. 7 is a flowchart illustrating details of an image disposition process.

FIG. 7 is a flowchart illustrating the image disposition process in detail.

First, the printer driver 111 thins out a part of the images in the overlapped area with respect to the metallic image and the color image overlapped on the medium S to alternately dispose the images on the medium S by the image disposition processing unit 114 (Step S31). Specifically, in the overlapped area on the medium S, the image data in which the metal ink and the color ink are not overlapped and ejected to the same pixel is generated. That is, the pixel that is a thinning-out target with respect to the metallic image and the pixel that is a thinning-out target with respect to the color image are at different positions on the medium S.

In addition, as described above, without thinning out a part of the images of the metallic image and the color image and alternately disposing the images on the medium S, the image data of the metallic image and the color image alternately disposed on the medium S in advance may be acquired from the application program 104 in Step S10 shown in FIG. 6.

Figure 8A:
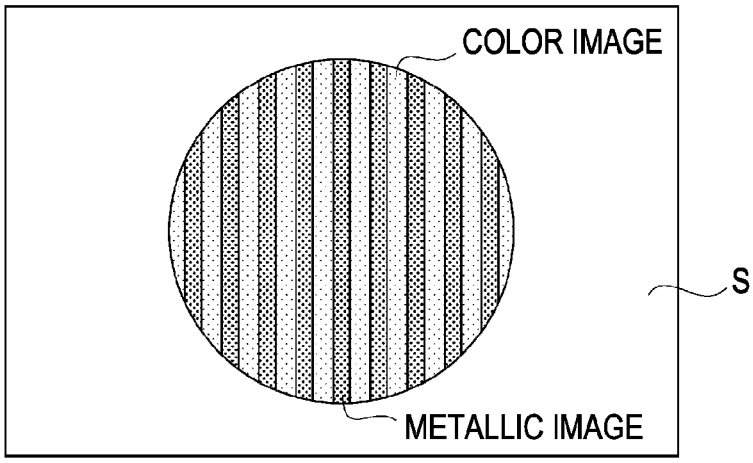
FIG. 8A to FIG. 8C are diagrams illustrating examples of an image disposition pattern of a metallic image and a color image.
Figure 8B:
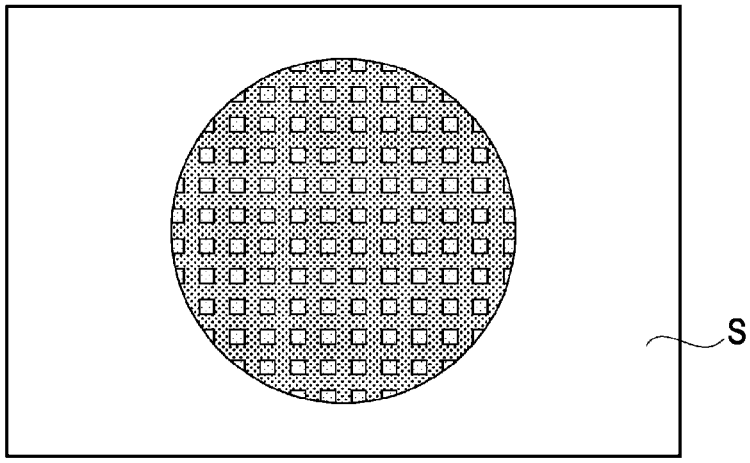
Figure 8C:
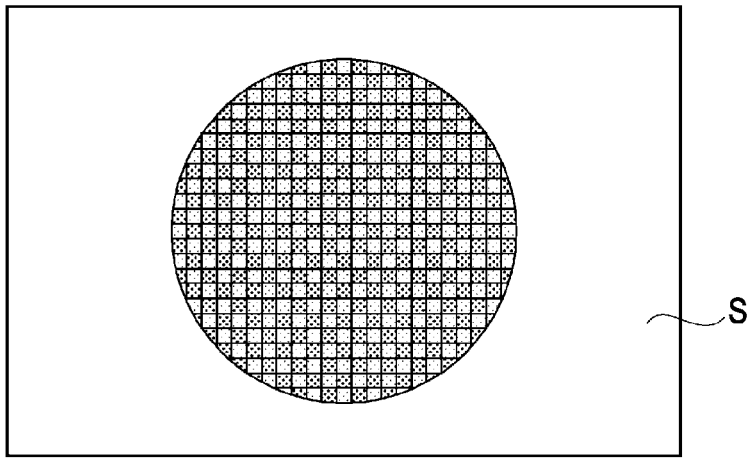

FIG. 8A to FIG. 8C are diagrams illustrating image disposition patterns of the metallic image and the color image. FIG. 8A is an example of an image disposition pattern printed when the dots are thinned out and disposed such that the metallic image and the color image are in stripes. FIG. 8B is an example of an image disposition pattern printed when the dots are thinned out and disposed such that the metallic image and the color image are a grid shape. FIG. 8C is an example of an image disposition pattern printed when the dots are thinned out and disposed such that the metallic image and the color image are a checker board shape. Herein, the width of the alternately disposed images is preferably finer, for example, preferably a range of 0.01 mm to 10 mm. In addition, it is preferable that the image disposition pattern be a striped pattern shown in FIG. 8A.

In addition, in the drawing of the embodiment, the part of the metallic image is indicated by dark hatching, and the part of the color image is indicated by thin hatching.

Returning to FIG. 7, then, the printer driver 111 disposes the color image in the outline area of the image, with respect to the image in which the metallic image and the color image generated in Step S31 are alternately disposed, by the image disposition processing unit 114 (Step S32). Specifically, the image data of ejecting the color ink is generated with respect to the pixels forming the outline area of the image on the medium S.

Figure 9A:
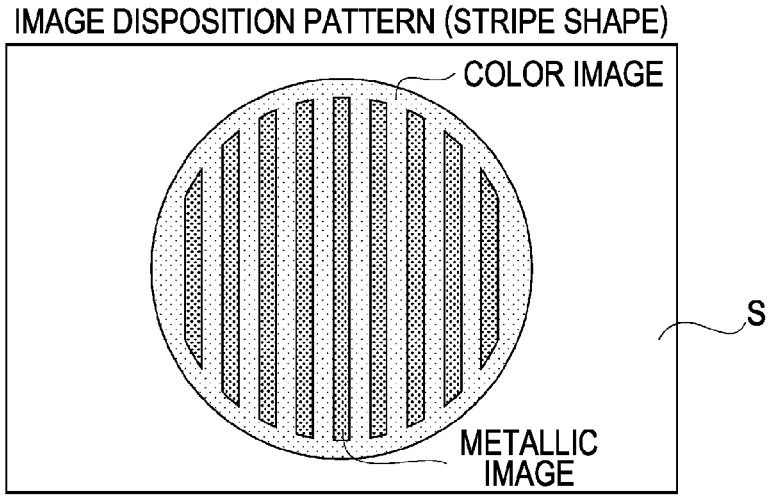
FIG. 9A to FIG. 9C are diagrams illustrating examples in which a color image is disposed in an outline area of an image formed of a metallic image and a color image.
Figure 9B:
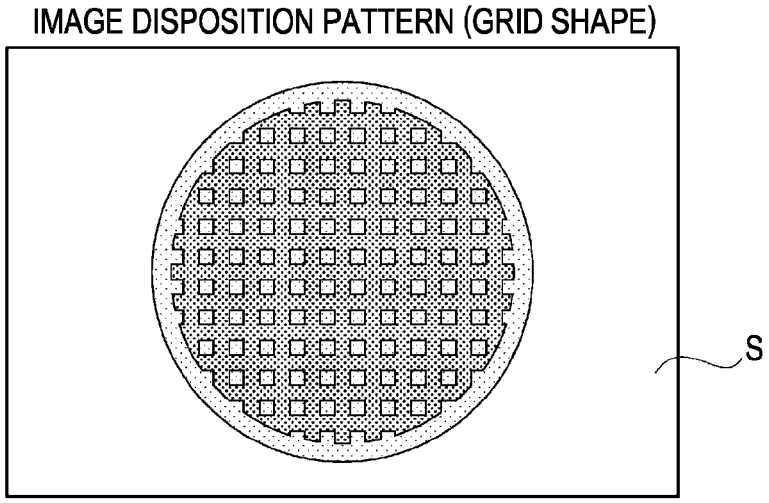
Figure 9C:
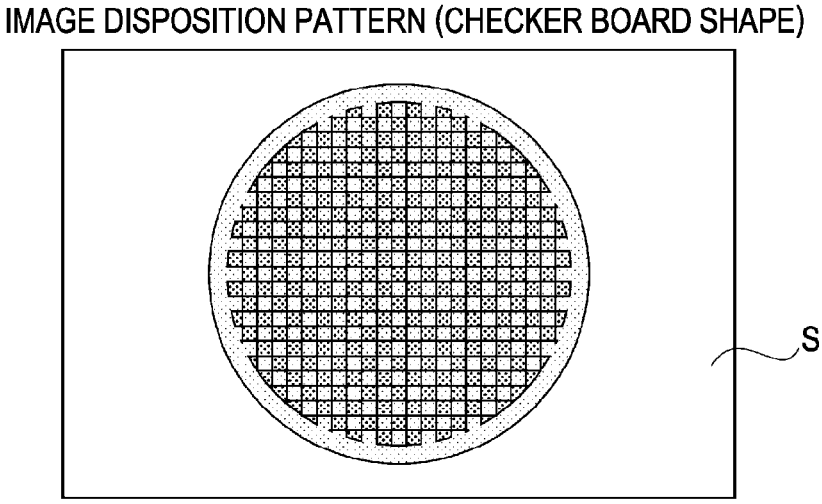

FIG. 9A to FIG. 9C are diagrams illustrating examples of disposing the color image in the outline area of the image formed of the metallic image and the color image. FIG. 9A is an example of disposing the color image in the outline area of the image disposition pattern shown in FIG. 8A. FIG. 9B is an example of disposing the color image in the outline area of the image disposition pattern shown in FIG. 8B. FIG. 9C is an example of disposing the color image in the outline area of the image disposition pattern shown in FIG. 8C.

Figure 10A:
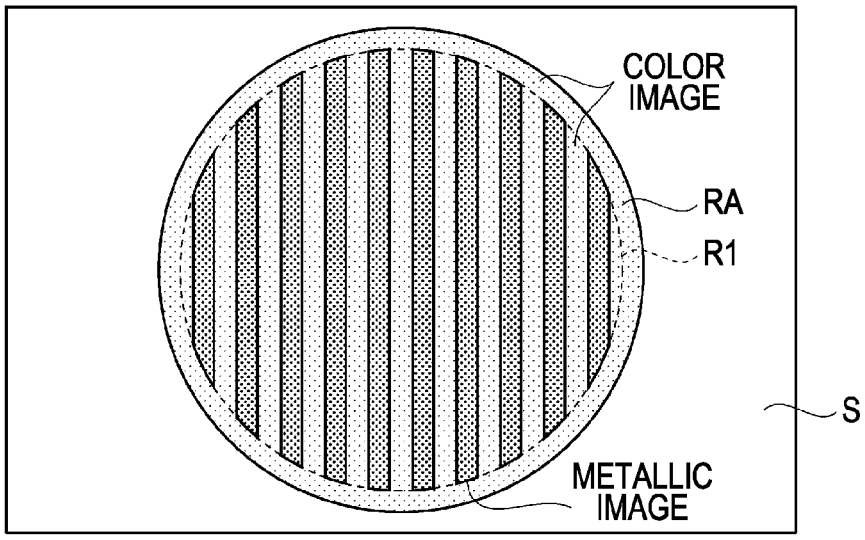
FIG. 10A and FIG. 10B are diagrams illustrating a method of disposing a color image in an outline area of an image disposition pattern.
Figure 10B:
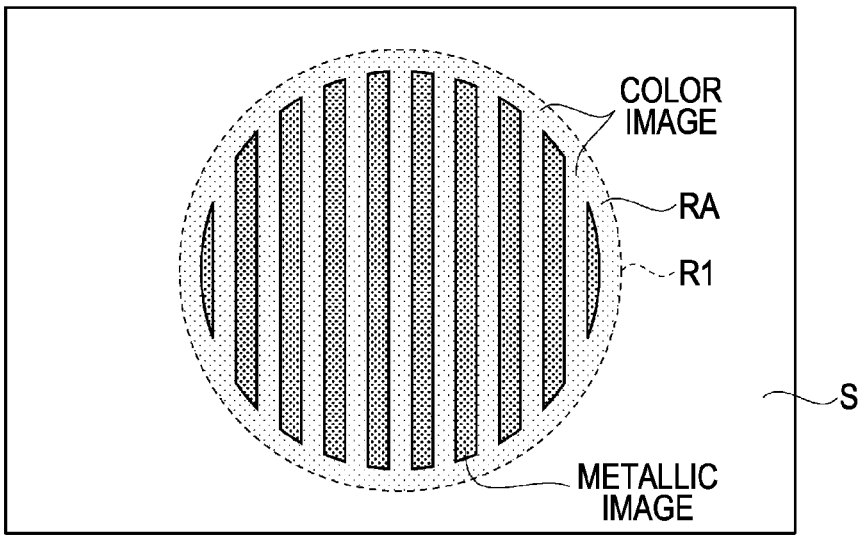

FIG. 10A and FIG. 10B are diagrams illustrating a method of disposing the color image in the outline area of the image disposition pattern shown in FIG. 8A. FIG. 10A is a diagram illustrating an example in which an area adjacent to the outside of the outline of the image is the outline area. FIG. 10B is a diagram illustrating an example in which an area adjacent to the inside of the outline of the image is the outline area. In FIG. 10A and FIG. 10B, R1 represents the outline of the image, and RA represents the outline area.

In FIG. 10A, the outline area RA is provided on the outside of the outline R1 of the image disposition pattern of the metallic image and the color image shown in FIG. 8A, and the color image is disposed in the outline area RA. In this case, the color image of the outline area RA is the same as the color of the color image on the inside of the outline R1. In addition, for example, when the color image on the inside of the outline R1 is not one color but a plurality of colors, the color is the same color as that of the part of the color image closest in position to the parts of the outline area RA.

Meanwhile, in FIG. 10B, the outline area RA is provided on the inside of the outline R1 of the image disposition pattern of the metallic image and the color image shown in FIG. 8A, and the color image is disposed in the outline area RA. In this case, since the outline area RA is provided on the inside of the outline R1 and the color image is disposed therein, the image data is changed so as not to eject the metal ink to the pixels of the metallic image overlapped with the outline area RA. The color image of the outline area RA is not the color of the color image originally present in the outline area RA. In addition, for example, when the color image originally present in the outline area RA is not one color but a plurality of colors, the color is the same color as that of the part of the color image which is closest in position, at the part that is the originally metallic image.

Figure 11A:
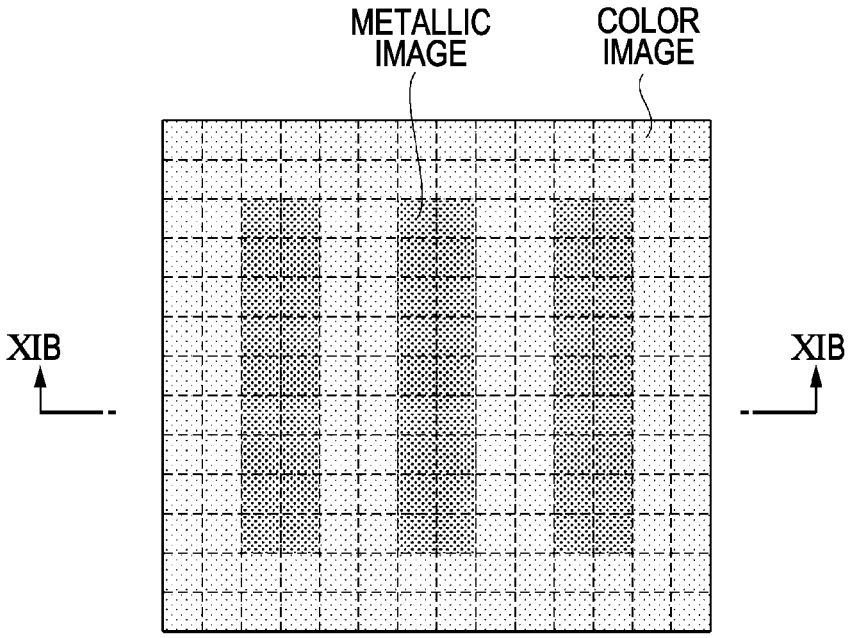
FIG. 11A and FIG. 11B are diagrams illustrating an example of an image formed of a metallic image and a color image by a pixel unit.
Figure 11B:
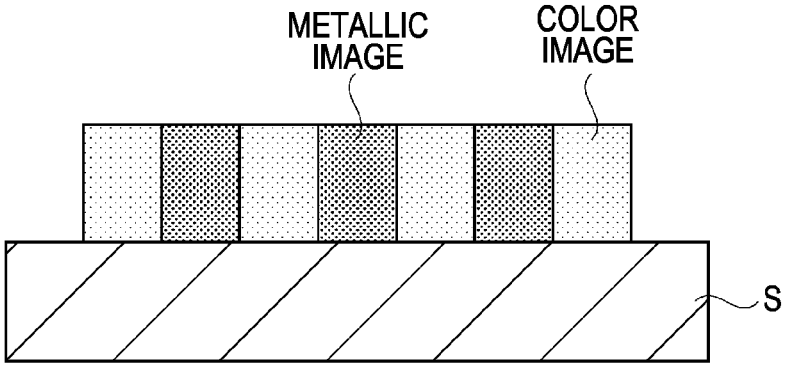

FIG. 11A and FIG. 11B are diagrams illustrating examples of images formed of the metallic image and the color image by a pixel unit. FIG. 11A shows disposition of the metallic image and the color image by a pixel unit. FIG. 11B shows a cross-section of XIB-XIB of FIG. 11A. In FIG. 11A, one cell represents one pixel, and the metallic image of a horizontal width of two pixels and the color image of a horizontal width of two pixels are alternately disposed. In addition, the pixels of the color image of the horizontal width and the vertical width of two pixels that are the outline area are disposed around the alternately disposed metallic image and color image. Meanwhile, in FIG. 11B, the metal ink and the color ink are ejected onto the medium S, and the metallic image and the color image are alternately formed thereby.

In the embodiment described above, for example, as shown in FIG. 9A to FIG. 9C, the metallic image and the color image are alternately disposed on the medium S, and thus it is possible to realize a metallic image having satisfactory metal luster and color tone. In addition, as compared with the method of overlapping and printing the metallic image and the color image in the related art, it is possible to shorten the printing time, and it is possible to reduce the printing cost by reducing the amount of ink.

In addition, as shown in FIG. 9A to FIG. 9C, the color image is disposed in the outline area of each image, and thus it is possible to make the boundary portion between the medium S and the image, which is the outline area, a blurred impression, as compared with FIG. 8A to FIG. 8C. Accordingly, it is possible to suppress that the entire image floats on the medium S.

In addition, in FIG. 10A, the color image is disposed in the outline area RA provided on the outside of the outline R1 of the image. Accordingly, it is possible to suppress that the entire image floats on the medium S in a state where the areas of the metallic image shown in FIG. 8A is held as is. Meanwhile, in FIG. 10B, the color image is disposed in the outline area RA provided on the inside of the outline R1 of the image. Accordingly, it is possible to suppress that the entire image floats on the medium S in a state where the size of the entire area of the image disposition pattern shown in FIG. 8A is held as is.

Modification Example 1

In FIG. 10A and FIG. 10B of the embodiment described above, the example of disposing the color image in the outline area RA on the outside and the inside of the outline R1 of the image is described. In this case, the outline area RA is set such that the line width of the color image disposed in the outline area RA is substantially the same as the line width of the color image disposed in the inside of the outline area RA, that is, the area surrounded with the outline area RA. However, the invention is not limited thereto, the line width of the outline area RA may be further broadened to be thicker than the line width of the color image or the metallic image disposed on the inside of the outline area RA.

Figure 12:
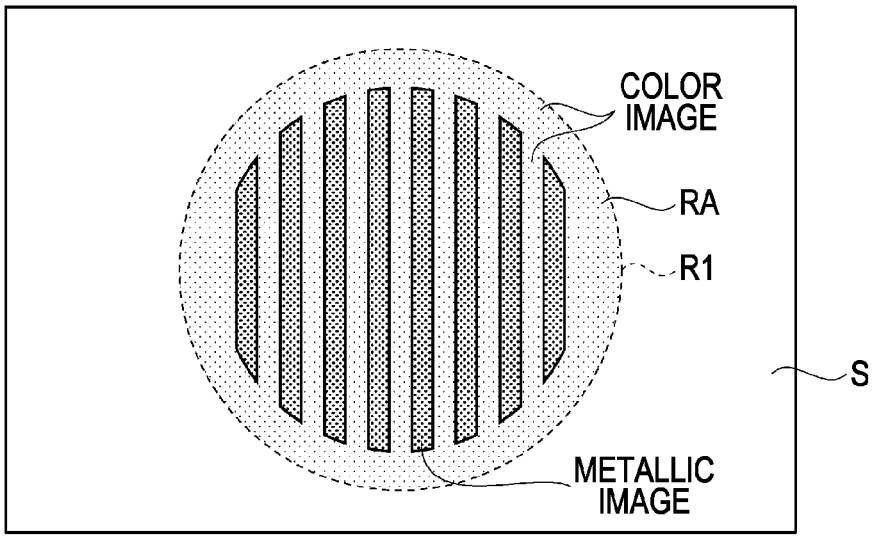
FIG. 12 is a diagram illustrating an example in which a line width of an outline area provided on the inside of an outline of an image is further broaden.

FIG. 12 is a diagram illustrating an example of further broadening the line width of the outline area RA provided on the inside of the outline R1 of the image. In FIG. 12, as compared with FIG. 10B, the line width of the color image disposed in the outline area RA is thicker than the line width of the color image or the metallic image disposed on the inside of the outline area RA. As described above, the line width of the color image disposed in the outline area RA is thick, and thus it is possible to further clarify the boundary portion between the medium S and the image. Accordingly, it is possible to further suppress that the entire image floats on the medium S.

Modification Example 2

In FIG. 11A and FIG. 11B of the embodiment described above, the example of the image formed of the metallic image and the color image by a unit pixel. Herein, the metallic image with the horizontal width of two pixels and the color image with the horizontal width of two pixels are alternately disposed without a gap. However, the invention is not limited thereto, and the metallic image and the color image may be alternately disposed with a gap provided therebetween.

Figure 13A:
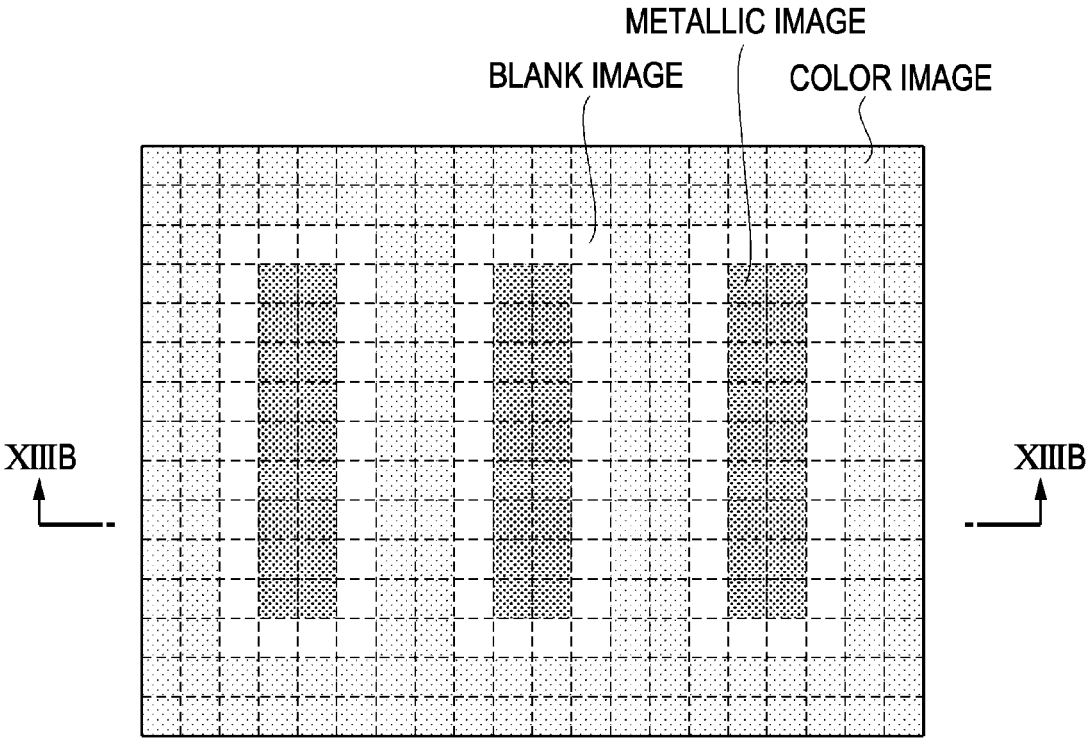
FIG. 13A and FIG. 13B are diagrams illustrating an example of an image in which a gap is provided between a metallic image and a color image.
Figure 13B:
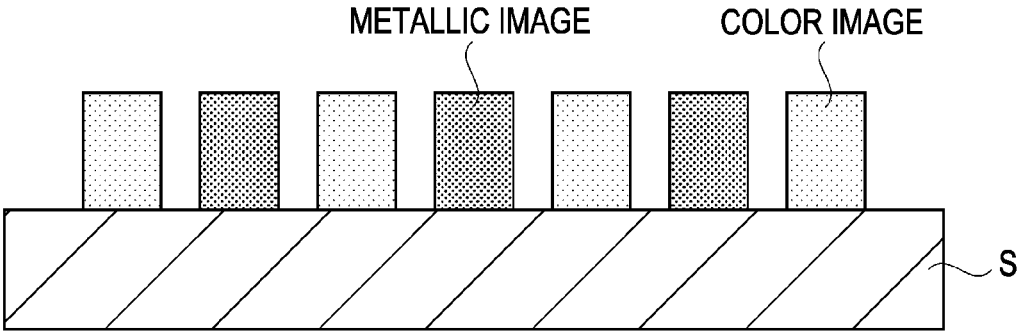

FIG. 13A and FIG. 13B are diagrams illustrating examples in which a gap is provided between the metallic image and the color image. FIG. 13A shows disposition of the metallic image and the color image by a pixel unit. FIG. 13B shows a cross-section of XIIIB-XIIIB of FIG. 13A. In FIG. 13A and FIG. 13B, blank pixels of a horizontal width and a vertical width of one pixel are provided between the metallic image and the color image. As described above, the blank pixels of one pixel are provided, it is possible to avoid contact between metal ink dots and color ink dots, and thus it is possible to prevent blurring or mixed color between both ink dots from occurring. Accordingly, it is possible to perform printing of the image with higher image quality while shortening the printing time.

Modification Example 3

In the embodiment described above, the example of performing the printing using the ink of four colors of KCMY as the color ink is described. However, the invention is not limited thereto, and the printing may be performed using color ink other than KCMY, such as light cyan, light magenta, white, and clear. In addition, the example of ink containing the silver particles and the aluminum particles as the metal ink is described, but ink containing other particles such as copper or gold may be used as long as it is possible to reproduce metal luster at time of printing.

Modification Example 4

In the embodiment described above, the piezoelectric element is exemplified as the element that performs the operation for ejecting the ink droplets, but the other element such as a heat generation element or an electrostatic actuator may be used.

In addition, the printer 1 of the type of moving the head 41 with the carriage 31 is exemplified, but the printer may be a so-called line printer in which a head is fixed.

What is claimed is:

1. A printing apparatus, the printing apparatus comprising:

a print head having a first nozzle for ejecting a color ink and a second nozzle for ejecting a metal ink, wherein a printing image is formed in which a metallic image portion formed of the metal ink and a first color image portion formed of the color ink are alternatively disposed on a print medium, the color ink and the metal ink being ejected by an identical scan of the print head, wherein the printing image further includes a second color image portion which is disposed in an outline area of the printing image, wherein the second color image portion disposed in the outline area surrounds the metallic image portion and the first color image portion to thereby define a boundary between the printing image and the medium, wherein a line width of the color image disposed in the outline area is larger than a line width of the color image disposed in an area surrounded in the outline area.

2. The printing apparatus according to claim 1, wherein the outline area is an area adjacent to the outside of an outline of the printing image.

3. The printing apparatus according to claim 1, wherein the outline area is an area adjacent to the inside of an outline of the printing image.

* * * * *